US005595494A

United States Patent [19]

Wiebe

[11] Patent Number: 5,595,494

[45] Date of Patent: Jan. 21, 1997

[54] UNIVERSALLY MOUNTED POWER STRIP

[75] Inventor: Donald G. Wiebe, Hacienda Heights, Calif.

[73] Assignee: Damac Products Inc, Sante Fe Springs, Calif.

[21] Appl. No.: 318,443

[22] Filed: Oct. 5, 1994

[51] Int. Cl.[6] ..... H01R 4/60

[52] U.S. Cl. ..... 439/211; 439/114; 439/535; 439/209; 174/48

[58] Field of Search ..... 439/207, 209, 439/210, 211, 212, 214, 501, 535, 208; 174/48, 49, 70 C, 72 C

[56] References Cited

U.S. PATENT DOCUMENTS

| | | | |
|---|---|---|---|
| 3,148,008 | 9/1964 | Herrmann | 439/114 |
| 3,889,044 | 6/1975 | Flachbarth et al. | 174/48 |
| 4,017,137 | 4/1977 | Parks | 439/211 |
| 4,165,443 | 8/1979 | Figart et al. | 439/535 |
| 4,323,836 | 4/1982 | Rice | 174/48 |
| 4,867,701 | 9/1989 | Wiand | 439/501 |
| 4,872,849 | 10/1989 | Long | 439/209 |
| 5,071,367 | 12/1991 | Luu | 439/501 |
| 5,162,614 | 11/1992 | Bogiel et al. | 174/48 |
| 5,274,972 | 1/1994 | Hansen | 174/48 |

FOREIGN PATENT DOCUMENTS

| | | | |
|---|---|---|---|
| 2417472 | 4/1974 | Germany | 439/208 |
| 2229869 | 3/1990 | United Kingdom | 439/209 |

OTHER PUBLICATIONS

Spring Steel Fasteners, inc. Catalog #7, Feb. 1, 1969, p. 3.

*Primary Examiner*—David L. Pirlot
*Assistant Examiner*—Tho D. Ta

[57] ABSTRACT

A power strip supporting a plurality of power outlets for distributing power within an electronic cabinet or to an electronic rack has two identical housing pieces each having a right angle corner between a bulbous end and a groove end all of which extending the entire length of the housing, such that, when the bulbous ends are slidably inserted into the groove ends, the two pieces form a substantially square cross section of improve strength of construction having two tightly fitted mated corners and the two right angle corners all four of which are formed with a flange also extending the length of the power strip then adapted to received one or more clips which may be clipped onto the power strip on any one side and anywhere along the length of the power strip so that the power strip can be fastened by a hole in the clips to a cabinet or rack in a variety positions to face the power outlets in a variety of desired directions for ease of routing power wires which may be further routed through wiring routers also fastened using the clips in a variety of positions along the power strip at the ends of which are plastic end caps using screws screwed into the right angle corners to prevent the two pieces from sliding relative to each other.

13 Claims, 2 Drawing Sheets

UNIVERSALLY MOUNTED POWER STRIP

REFERENCE TO RELATED APPLICATION

The present invention relates to assignee's co-pending application entitled Universal Rack Wire Management Panel, Ser. No. 08/251,513 filed May 31st, 1994.

FIELD OF INVENTION

The present invention relates to electronic cabinet mounting and wiring apparatus. More specifically, the present invention relates to power strips adapted for mounting within an electronic cabinet or an electronic relay rack.

BACKGROUND OF THE INVENTION

Electronic cabinets have been used for sometime to house and support electronic modules. Each cabinet has four horizontal frame members generally attached in the shape of a square defining a cabinet top, another four horizontal frame members defining a bottom, and two left and two right vertical frames members extending vertically along the four corners of the cabinet between respective top and bottom corners and defining a front, back, left side and right side of the cabinet. The top, bottom and side skeletal frame members may or may not support sheet metal panels including a top panel, bottom panel, left side panel, right side panel, front panel and back panel all of which serve to enclose the interior space of the cabinet. The front and back panel may or may not include a door for access to the interior of the cabinet defined by all of the panels. The left side of the cabinet is defined by the two left vertical cabinet frame members and the right side of the cabinet is defined by the two right vertical cabinet frame members. Between the two left vertical cabinet frame members and also between the two right vertical cabinet frame members are horizontally positioned struts which strengthen the frame of the cabinet and which are used to support electronic racks. The cabinet may house one or two electronic racks each having a vertically extending left supporting frame member and a vertically extending right supporting frame member both of which have a vertically extending row of mounting holes for receiving mounting screws for mounting electronic modules horizontally between the left and right rack supporting frame members, as is well known. Standard size electronic racks have standard width and height dimensions and have standard mounting holes that have become universally accepted. One standard size electronic rack, among many, is the standard, rectangular frame, EIA electronic relay rack. The standard relay rack provides a standard width of nineteen inches, and is commonly referred to as the nineteen inch relay rack, but may also be manufactured in a variety of widths, including the standard twenty-three inch version. The standard size relay rack is also manufactured with a standard height of seven feet, but may also be manufactured in a variety of heights, including standard four, six and eight feet heights. The mounting holes are spaced apart to provide for a maximum number, typically forty-two, electronic rack module positions vertically along the height of the rack.

The cabinet may include one or two electronic racks each of which is defined by opposing left and right vertical frame members between which extend horizontally mounted electronic modules. Each left and each right electronic rack vertical frame member is rigidly attached to respective left and right horizontal struts. Each vertically extending rack frame member also has respective orthogonally extending flanges with several screw supporting holes for screw attachment to respective nuts placed within the struts. Each strut is generally in the form of an elongated rectangular bar having an elongated rectangular cavity. One elongated side of each strut has an elongated slot which extends the length of the strut and faces the interior of the cabinet. The rectangular cavity receives nuts which may be slidably positioned anywhere along the length of the rectangular cavity. The horizontal elongated extending slot of a strut is used to receive supporting screws from the orthogonally extending flange supporting holes of the rack frame. The supporting screws from the rack are screwed into and fastened to the nuts retained within the rectangular cavity of the struts to secure the rack to struts of the cabinet. Thus, the strut retains nuts which are fastened to supporting screws which may be fastened in respective supporting holes of the orthogonal flanges of an electronic rack to thereby secure the racks to the struts within the cabinet. Each strut also has two opposing ends which are attached to either the two left or two right vertically extending cabinet frame members on each side of the cabinet.

In a typical configuration, the cabinet may have a front rack, a back rack, left and right lower struts positioned near the bottom on the cabinet, left and right middle struts and left and right top struts positioned near the top of the cabinet. Thus, a cabinet can have one or more racks each having a left and right vertically extending frame member attached to one or more left and right struts and supporting a plurality of electronic modules, as is well known. The electronic racks support the electronic modules each of which typically having a power cord through which power is supplied. There has existed from some the need to route electrical power within the cabinets and more particularly to supply power to various electronic modules supported within the cabinets and more particularly mounted on the vertically extending rack frames.

Various means have been employed to conveniently route power cables within the cabinets to distribute power throughout an electronic rack within the cabinet. Cable routers of a variety of types have been used in cabinets to route wires. One such router is the Universal Wire Management Panel of the referenced related application. The wire panel has a plurality of parallel spaced slit rings through which wires are routed and to which are integrally attached rods onto which are attached clips which are used to clip the wire panel to the rack vertical frame members. Each clip has a screw hole through which a screw fastens the clip to the vertical rack frame members. The wire panel can be clipped and fastened either vertically along a rack frame or horizontally between to opposing rack frames.

Additionally, the vertically extending rack frame members and the horizontally extending struts provide stable structures onto which may be positioned electrical distributing devices, such as power strips having one or more electrical outlets, typically of the three socket variety for receiving common two or three prong electrical plugs, or for receiving two or three prong transformers both of which having respective electrical cords extending to the electronic modules.

The power strips are generally elongated rectangular strips having a square cross section and ends between which are positioned the power outlets disposed on one of the four elongated sides. The power strips may be manufactured by well known aluminum extrusion processes in a variety of lengths. For examples, two feet, four feet and six feet industrial power strips have from eight to twenty outlets. The power strip housing is generally of a two piece construction of either a dual U design or a flat U design. The dual U design has two U shaped elongated opposing pieces positioned facing each other forming a square cross section and connected together by a lip and groove pressure fit. The flat U design has a bottom U shaped elongated piece covered by a substantially flat piece positioned on top the bottom U shaped piece also forming a square cross section and also connected together by the lip and groove friction pressure fit.

These power strips are provided in a variety of lengths supporting a respective plurality of power outlets. The electronic modules typically have respective power cords with end three prong plugs which are routed to the power strips and more particularly to the outlets and inserted therein to route and supply power to the electronic modules. Each power strip typically has one standard three prong power cord extending external to the cabinet to an external power source and has a plurality of power outlets to route power to a plurality of respective electronic modules each having a respective power cord. Each power strip may contain a variety of electronic devices and circuits to enhance the distribution of electrical power through the power outlets. For examples, the power strips may contain a on-off switch for connecting power to all of the outlets or plurality of on-off switches for respectively connecting power to respective outlets. For other examples, the power strips may also contain circuit breakers, fuses, power taps, EMI filters, transient voltage surge suppressors, and indicator power on-off lamps. These electronic components including the outlets are positioned on or within the elongated housing of the power strip. The power strip may also have internal grooves extending along the power strip and used to support circuit boards which may support internally positioned power strip electronics. The power strips have provided many useful electrical power distribution functions and are supported in a variety of positions within the electronic cabinets.

Typically two substantially square plastic end caps are positioned at the end of the power strip to enclose the cavity of the elongated power strip and to improve the structural strength of the power strips. The end caps may have a recess for receiving a double D shaped circuit breaker. The end caps also have screw holes receiving screws which are screwed into receiving bulbous grooves usually formed at all four corners of the extruded aluminum housing U shaped of flat shaped pieces. The power strip relies substantially in part upon the end cap screws to secure the two housing pieces together in addition to the lip and groove pressure friction fit running along the length on both sides of the power strips.

The power strips are typically rigidly attached within the cabinet. A rack mounted power strip is nineteen inches in length with end mounting holes at both ends for horizontal positioning on the electronic rack and for distributing power to the electronic modules on the rack. The power strips can also be attached vertically along the length of either the left or right vertically extending rack frame members. Further still, a power strip can also be attached horizontally along the length of a cabinet strut or attached vertically between two struts on one side of the cabinet. Power strip clips have been used to rigidly attach power strips to the rack frame members and to cabinets struts. The clips are generally flat square shaped pieces each with a center screw hole and with two opposing flanges which are pressure fit into power strip receiving flanges extending along the length of the bottom of the power strips. The power strip receiving flanges extend along the length of the bottom side of the power strip opposing the top side supporting the power outlets. There is a space between the bottom side of the power strip and the clip hole for receiving a bolt head or nut for attachment to the rack frame members or to the struts.

One problem associated with the dual U shaped or flat U shaped design is the tendency on the two elongate pieces to separate from each other at the lip and groove friction fit when pulling a power plug out of one of the outlets. Another problem associated with the dual U shaped or flat U shape design is the reliance upon the use of the end caps and end cap screws to secure the two housing pieces together. The end caps positioned at the end of the housing do not substantially prevent the separation of the housing pieces due to the tendency of the housing pieces to bend and spring apart during removal of the power cord plugs, even though the end cap tend to keep the two housing pieces in relative longitudinal alignment so that the two pieces do not slide longitudinally against each other during use.

Another problem of the dual U shaped or flat U shaped design using the bottom receiving flanges and substantially flat power strip clips is the limited use of those flat power strip clips which to serve to position the power strip in only one position relative to the placement of clip within a cabinet. The power strip clips are positioned along only the bottom side of the power strip to disadvantageously limit the positioning of the outlets to only one position relative to the placement of the power strip clips. The power outlets always face away from the clips.

Yet another problem of the dual U shaped or flat U shaped design using the bottom receiving flanges is the limited number of power strips positions available within the cabinet. With the use of the bottom receiving flanges and the substantially flat power clips vertically attached to a rack frame member, the outlets of the power strip disadvantageously faces either towards the front when positioned on the front side of a vertically extending rack frame member or towards the back when positioned on the back side of a vertically extending rack frame member. With the use of the bottom receiving flanges and the substantially flat power clips horizontally attached between two rack frame members, the power strip disadvantageously faces either towards the front when position on the front side of the vertically extending rack frame members or towards the back when positioned on the back side of a vertically extending rack frame members. With the use of the bottom receiving flanges and the substantially flat power clips horizontally attached along the length of a horizontal strut, the power strip disadvantageously faces only towards the interior of the cabinet. With the use of the bottom receiving flanges and the substantially flat power clips vertically attached between two struts, the power strip disadvantageously faces only towards the interior of the cabinet. The routing of power wires and the placement of power strips have disadvantageously limited those individuals configuring the internal cabinet wiring who would otherwise prefer to have as many wiring options as possible. For example, transformers in the power strips facing the front rather than the side may be inadvertently bumped by operators and interrupting power to the electronic modules. Furthermore, power cords may not be easily routed away from operator exposure if the power strips are limited to a few available positions. These and other disadvantages are solved or reduced using the present invention.

SUMMARY OF THE INVENTION

An object of the present invention is to enhance the structural strength of power strips.

Another object of the present invention is provide a slidably interlocking mating means extending the length of the power strips to enhance the structural strength of the power strips.

Another object of the present invention is to provide power strip housings formed by a single extrusion process providing interlocking mating housing pieces also receiving screws for attaching power strip end caps.

Yet another object of the present invention is to provide power strip clips which are easy to install and remove.

Yet another object of the present invention is to provide power strip clips which are positioned anywhere along the length of the power strip and on any one of four elongated sides of the power strip.

Still another object of the present invention is to provide a power strip which is adapted to receive a fastening means suitable for attached to rack holes, strut slots, or wire routing panel clip holes.

Still a further another object of the present invention is to improve the variety of positioned which may be assumed by a power strip in an electronic cabinet or on an electronic rack.

One aspect of the present invention is a power strip housing including two identical right angle pieces each of which having a groove receiving end and a bulbous insertion end both extending the length of the housing pieces. The groove receiving end is adapted to be slidably received by insertion into the bulbous insertion end. The two identical right angle pieces are preferably made by an aluminum extrusion process for improved manufacturability. The two right angle pieces can be slidably fitted together forming a substantially square cross section power strip housing when slidably inserted together. The two bulbous insertion ends are slidably inserted into the respective two groove receiving ends for improved strength of final housing construction. The right angle pieces advantageously do not suffer from the weak fit of a lip and groove friction fit.

In another aspect of the invention, each of the two right angle pieces have a bulbous groove corner for receiving screws in relative diagonal positions at both the distal and proximal ends of the power strip for securing end caps thereto. The end caps advantageously secure the two right angles pieces together preventing them from sliding relative to each other during use.

In yet another aspect of the invention, the right angle pieces are formed with corner flanges extending longitudinally along each of the four corners of the housing. The corner flanges are formed exterior to and along each of the two bulbous groove corners of the housing and are form exterior to and along each of the two groove receiving ends so that each corner of the housing has a corner flange extending the entire length of the housing. The four corner flanges are used to support power strip clips anywhere along the length of any one of the four sides of the housing of the power strip. The positioning of the power strip clips on any side and at any point along the length of the power strip enables the power strip to be placed in a variety of positions within the cabinet to advantageously face the outlets in any one of four directions relative to the placement of the clips for improved wire routing.

In yet another aspect of the invention, the power strip clips are generally U shaped having two opposing arms to not only advantageously provide for spring clipping to opposing edges of the corner flanges of any two corners of one of the four sides, but also to advantageously create a space between a clip hole and the surfaces of the one side of the power strip to receive a nut or bolt head either of which can be used to attach the power strip to an electronic rack hole, a strut slot, or other cabinet wire routing means, such as a wire routing panel clip hole for securing a wire routing panel to the power strip for enhanced wire routing.

In still another aspect of the invention, the power strip clip have a manipulating extension lever formed on at least one of the clip arms for easy removal or insertion of the power strip clip along the power strip.

The above aspects of the invention provide for an improved power strip having improved manufacturability, improved structural strength, more varied positioning within a cabinet and improve attachment means to rack frame members, cabinet struts or wire routers. These and other advantages will become more apparent from the following detailed description of the preferred embodiment.

DETAILED DESCRIPTION OF THE PREFERRED EMBODIMENT

Figure 1B:
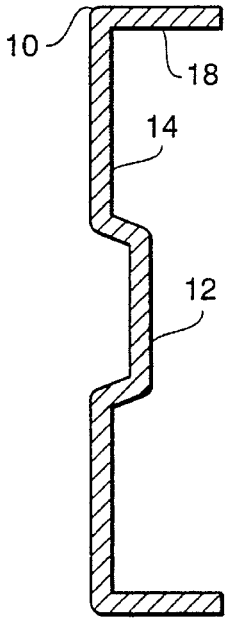
FIG. 1*b* is a cross sectional view of the end cap.
Figure 1A:
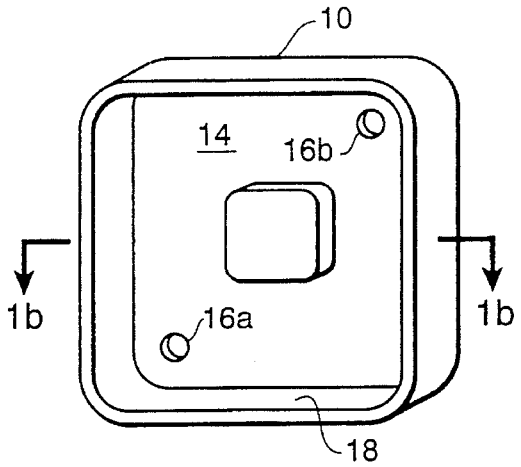
FIG. 1*a* is an isometric view of an end cap.

Referring to FIGS. 1*a* and 1*b*, an end cap 10 is preferably square with rounded corners. The cap 10 has a recess 12 centered within a cap flat 14 having two cap screw holes 16*a* and 16*b* disposed at opposing diagonal corners as shown. The recess 12 preferably has a double D hole, not shown, punched or drilled within the recess 12 for receiving and supporting a circuit breaker, not shown. Around the edges of the cap flat 14, orthogonally extends a cap flange 18. The end cap 10 is preferable made of a plastic material, though other materials could be used. The screw holes 16 are preferably not threaded and are used to receive appropriately sized screws, not shown.

Figure 2A:
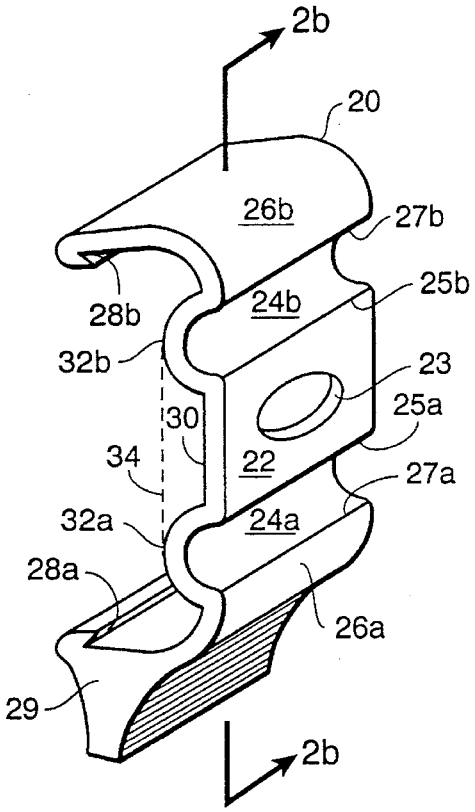
FIG. 2*a* is an isometric view of a power strip clip.
Figure 2B:
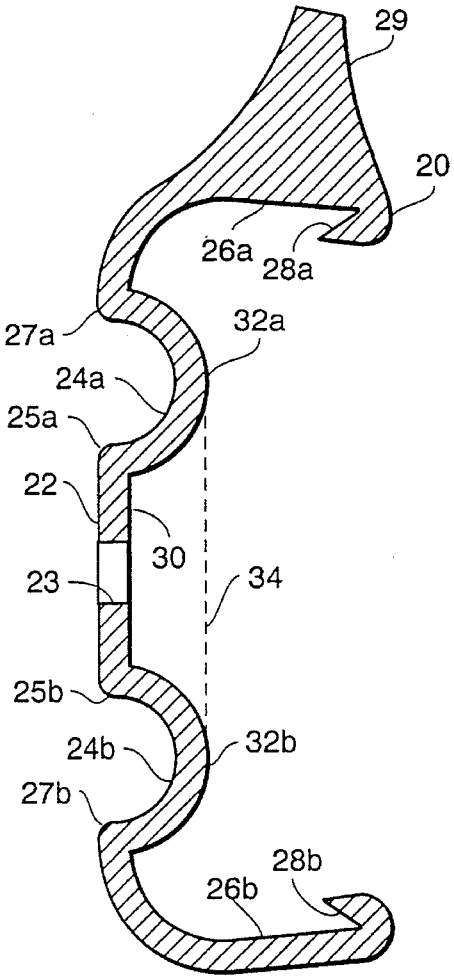
FIG. 2*b* is a cross sectional view of the power strip clip.

Referring to FIGS. 2*a* and 2*b*, a power strip clip 20 has preferably a square central flat 22 with a clip hole 23 centered within the flat 22. The clip flat 22 is integrally formed to two semi circle spacers 24*a* and 24*b* extending along respective opposing edges 25*a* and 25*b* of the flat 22, as shown. The spacer 24*a* and 24*b* have respective arms 26*a* and 26*b* integrally formed to respective terminating edges 27*a* and 27*b* of the spacers 24*a* and 24*b*, respectively. The arms 26*a* and 26*b* extend from the terminating edges 27*a* and 27*b* relative to the flat 22. The arms 26*a* and 26*b* have respective arm grooves 28*a* and 28*b* at the respective ends of the arms 26*a* and 26*b*. A clip lever 29 extends from one of the clip arms 26*a* and preferably has friction grooves for ease of manual manipulation. The frictions grooves, generally shown in FIG. 2*a*, are on both sides of the lever 29 extending across the entire length of lever 29. The extending arms 26 are curved to enable one of the arms 26*a* or 26*b* to be spread apart relative to each other by manual manipulation of the lever 29, and made of a resilient material, such as plastic, providing an elastic return to the original shape after manual manipulation without experiencing fatigue and clip failure even after many manipulations.

The spacer 24*a* and 24*b* initially preferably extend orthogonally from the opposing edges 25*a* and 25*b* of the flat 22 in a relative direction as do the extending arms 26*a* and 26*b*. The spacers 24*a* and 24*b* are shown generally in the form of a semi circle groove respectively extending along the two opposing edges 25*a* and 25*b* of the flat 22. Thus, spacers 24*a* and 24*b* have a semi circle cross section, as shown, each having a respective farthest point 32*a* and 32*b* at the mid point of the semi circle cross section. The mid points 32*a* and 32*b* extend longitudinally along the length of the spacer 24*a* and 24*b*. The mid points 32*a* and 32*b* are the farthest most points of extension of the spacers 24 from the bottom surface 30. A line 34, drawn in phantom, extends between the mid points 32*a* and 32*b*. The distance between the line 34 and the bottom surface 30 of the flat 22 defines a space for receiving a nut or bolt head, both not shown, for securing the clip 20 to a stationary structure, not shown, such as an electronic rack having mounting holes, or a cabinet strut having nuts restrained therein. The clip 20 may also be used to support a wiring panel, not shown, for supporting and together form mated corners 56 and 57 which are not easily separated under manual pressure. When the bulbous insertion ends 52 and 53 are inserted into the receiving groove ends 55 and 54, the cavity 42 has two diagonally opposing mated corners 56 and 57 and two diagonally opposing bulbous groove corners 50 and 51, as shown.

The bulbous groove corners 50 and 51 have respective bulbous grooves 58 and 59 for receiving screws, not shown, at both ends of the housing pieces 40 and 41 used to secure respective plastic end caps 10 of the type shown in FIGS. 1*a* and 1*b*. Screw threads are cut into the ends of bulbous grooves 58 and 59 of the corners 50 and 51 respectively when the end cap screws are inserted through the end caps holes 16 and screwed into the bulbous grooves 58 and 59 of the corners 50 and 51 to secure the end caps 10 to the ends of a power strip.

Referring to FIGS. 1*a*, 1*b*, 2*a*, 2*b* and 3*a*, the mated housing pieces 40 and 41 have four corners 50, 51, 56 and 57. The corners 50, 51, 56 and 57 having external rounded flanges defined between two opposing flange edges 50*a* and 50*b*, 51*a* and 51*b*, 56*a* and 56*b*, and 57*a* and 57*b*, respectively. The flange corners 50, 51, 56 or 57 are rounded to receive at the ends of the housing pieces 40 and 41 the interior side of the rounded corners of the plastic end caps 10, and are rounded to receive anywhere along the elongated length of pieces 40 and 41, the interior side of the clip arms 26. The flange edges 50*a*, 50*b*, 51*a*, 51*b*, 56*a*, 56*b*, 57*a* and 57*b* are formed to receive clips arm grooves 28*a* and 28*b*, such that the clip 20 may be clipped by manual manipulation on the exterior of any of the four sides 44, 45, 46, 47 between flange corners 50 and 57, 57 and 51, 51 and 56, or 56 and 50 anywhere along the length of the pieces 40 and 41. The clip 20 may be positioned anywhere along the length of the exterior of any one of the four sides 44, 45, 46 and 47 in one of two positions defined by the relative placement of the clip lever 29. For examples, the clip 20 may be clipped to side 46 between corners 50 and 56 in two different positions either with the lever 29 extending from corner 56 then having the clip arm groove 28*a* fitted to flange edge 56*a* and clip arm groove 28*b* fitted to flange edge 50*b*, or with the level 29 extending from corner 50 then having clip arm groove 28*a* fitted to flange edge 50*b* and clip arm groove 28*b* fitted to flange edge 56*a*. Thus, the clip 20 can be positioned anywhere along the length of pieces 40 and 41, on any of four sides, 44, 45, 46 and 47 and in either of two different lever positions.

Figure 3A:
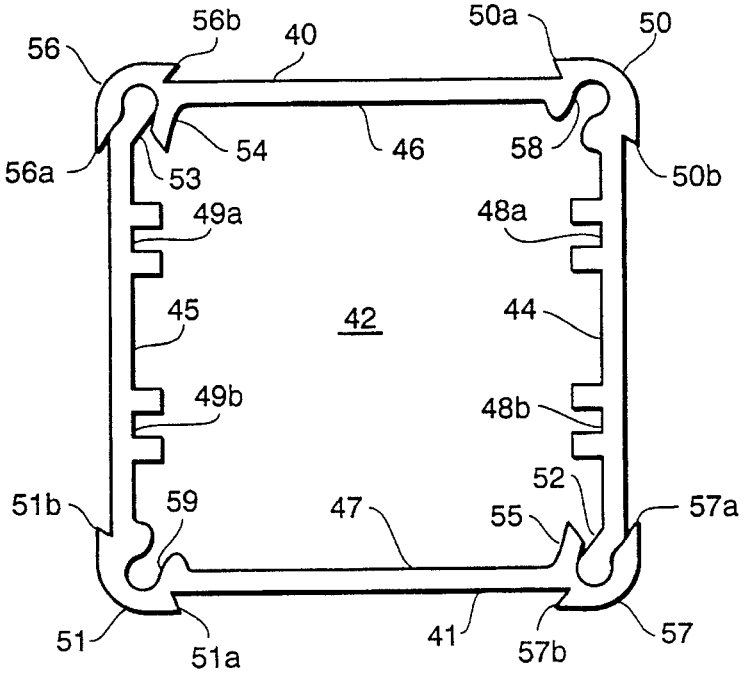
FIG. 3*a* is a cross sectional view of an assembled housing of the power strip.
Figure 3B:
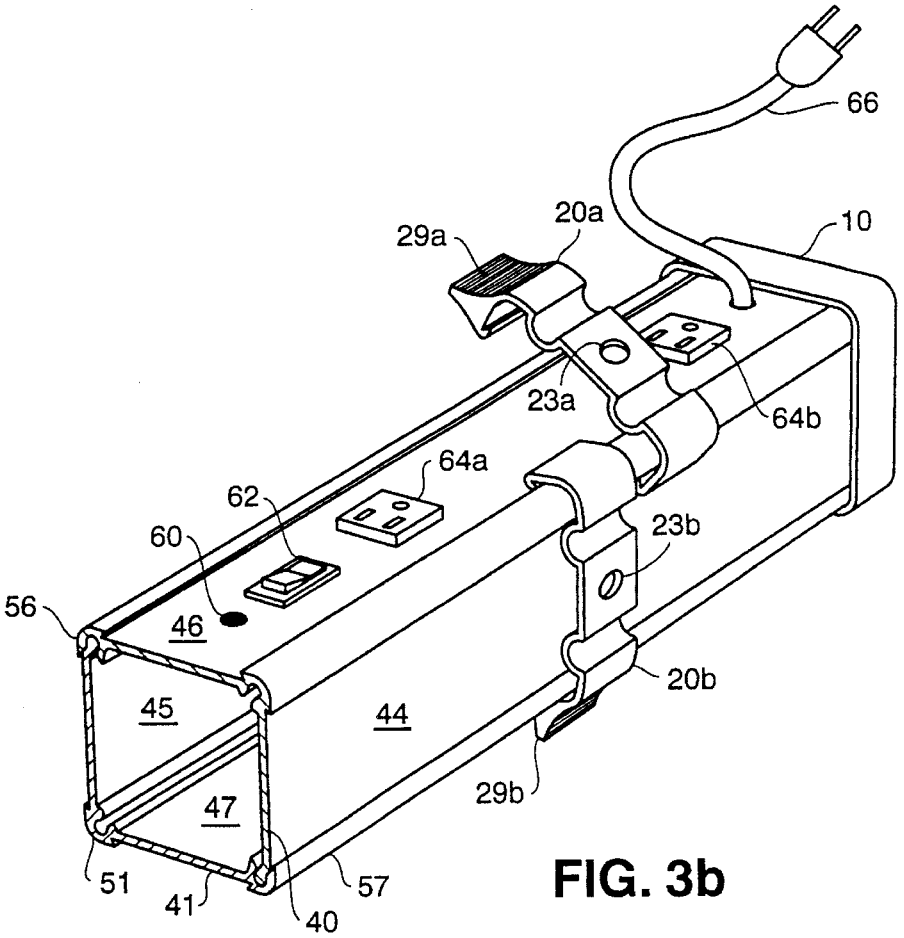
FIG. 3*b* is an isometric view of an assembled power strip having one end cap removed.

Referring to all of the Figures, and particularly to FIG. 3*b* showing a partially assembled power strip the two pieces 40 and 41 each have the two sides, 44 and 46, and 45 and 47, respectively. Side 46 is shown by way of example to have a power on indicator 60, a power-on switch 62, two power outlets 64*a* and 64*b*, and a power cord 66. The length of the power strip from the proximal end to the distal may vary as well as the length of the power cord 66. The number of outlets 64 may likewise vary, as only two are shown by way of example. The proximal end of the power routing wires, not shown, within the cabinet.

Referring to FIG. 3*a* showing a cross section view of the power strip housing having two preferably identical right angle pieces 40 and 41 defining a generally preferably square housing cavity 42, though a rectangular shaped housing cavity using two non-identical right angle pieces could be used. When two pieces 40 and 41 are identical, then only one aluminum extrusion process is needed to manufacture both of the pieces 40 and 41 having equal elongated lengths and cross section. Each right angle piece 40 and 41, has a first side 44 and 45, and a second side 46 and 47, respectively. Sides 44 and 45 are shown with internal slots 48*a* and 48*b*, and 49*a* and 49*b*, respectively. The slots 48 and 49 are formed by the aluminum extrusion process and used to support electronic circuit boards, not shown, extending between slots 48*a* and 49*a*, or between slots 48*b* and 49*b*. The circuit boards may support EMI filtering circuits, fuses, transient voltage protection circuits, and other power strip circuits, all not shown.

The housing pieces 40 and 41 include sides 44 and 45, and 46 and 47, bulbous groove corners 50 and 51, bulbous insertion ends 52 and 53 and groove receiving ends 54 and 55, respectively. The bulbous insertion ends 52 and 53 are slidably inserted into respective groove receiving ends 54 and 55 to form a snug fit along the entire length of the housing pieces 40 and 41. The bulbous insertion ends 52 and 53 have bulbous ends and the groove receiving ends 54 and 55 have mating bulbous grooves, as shown, which when mated strip is shown for convenience without an end cap 10 so as to expose the interior cavity 42 defined by the sides 44, 45, 46 and 47. Also for convenience, the power strip is shown without the circuit board slots 48 and 49 and the respective circuit boards, and without several reference designations shown in FIGS. 1*a*, 1*b*, 2*a*, 2*b* and 3*a*. An end cap 10 is shown fitted to the distal end of the partially assembled power strip. The end cap 10 may support a double D circuit breaker, not shown. The end cap 10 is screwed into the distal end of the power strip by screws, not shown, into grooves 59 and 58 through holes 16*a* and 16*b*.

Clip 20*a* is shown being either inserted onto or removed from side 46 between corners 50 and 56 with the lever 29*a* extending from the corner 56. Clip 20*b* is shown inserted onto side 44 between corners 57 and 50 with the lever 29*b* extending from the corner 57. The clip hole 23*a* is shown to be or to have been facing from side 46 whereas the clip hole 23*b* is shown facing from side 44. With respect to clip 20*b*, there is a space between the exterior of side 44 and the hole 23*b*, which space may receive a nut or a bolt head for securing the clip 20*b*, and therefore, the power strip to an external bolt or nut, respectively, not shown. When the clip 20*b* is inserted onto the power strip, the spacers 24*a* and 24*b* of the clip 20*b* at the point 32*a* and 32*b* may buttress against the side 44 to define that space between the side 44 and the bottom surface 30 of the flat portion 22 of the clip 20*b*. The space between the side 44 and the flat portion 22 of the clip 20*b* may receive a bolt head or a nut to fasten the power strip to an external device, not shown, for examples an electronic rack through a rack mounting hole, a cabinet strut through the strut slot, or a wiring routing clip through the wire router clip hole.

It should now be apparent that the power strip clips 20 and the flange corners 50, 51, 56 and 57 enable the power strip to be fastened to external apparatus including cabinet struts, rack frames and wiring panels with any one of the four sides of the power strip facing away from that external apparatus. It should also be apparent that the clips 20 may be fastened anywhere along the length of the power strip for varied positioning. As such, the power strip can be positioned so as to face the outlets 64 relative to those external apparatus in anyone of four directions, and fastened to such apparatus anywhere along the length of the power strip. For any given vertical supporting position, the power outlets can face the front, back, left side or right side of a cabinet or rack. For any give horizontal supporting position, the power outlets can face the front, back, top or bottom of the a cabinet or rack. The varied facing positions provide more flexible wiring options and placement of cords and transformers.

The power strip of the present invention exhibits improved strength of construction by virtue of the interlocking mating end 53 and 54, and 52 and 55 so that when a power cord, not shown, is removed from an outlet 60, the two pieces 40 and 41 remained locked and fitted together. The two identical pieces 40 and 41 are made from the same aluminum extrusion process and are easily fitted together with circuit boards and the end caps 10.

The two pieces 40 and 41 preferably have a right angle construction, though a different plurality of pieces with a different center angle could be used, for example, three pieces each with a 120 degree angle corner with the mating corner fitted at 120 degrees to provide six different clip attachment sides. The preferred clip 20 has two spacers 24*a* and 24*b*, but the clip 20 may be adapted to have no spacers at all with the arms 26*a* and 26*b* respectively extending from the opposing arms grooves 28*a* and 28*b* to the two opposing flat edges 25*a* and 25*b* of the flat portion 22 with the space between the side 44 and the bottom 30 of the flat portion 22 of the clip 20*b* defined by part of the interior surface of the arms 26*a* and 26*b*. In an alternative form of the invention, two levers may be integrally formed on respective clip arms 26, instead of only one lever 29 on only one clip arm 26*a*. In yet another form of the invention, exterior surfaces of flange corners 50, 51, 56 and 57 may be sharp right angle corners instead of rounded corners. While the preferred embodiment discloses power outlets 64 on only the one side 46, the outlets 64 could also be placed on the other sides 44, 45, or 47 or on a plurality of sides. While those skilled in the art may make improvements and modifications to the present invention, those improvements and modifications may nonetheless fall within the spirit and scope of the following claims.

What is claimed is:

1. A power strip for distributing power from a power source to a plurality of electronic modules through a respective plurality of power cords, said power strip has an elongated length, said power strip comprising, a plurality of angled pieces each having a bulbous end and a groove end between which is an angled corner, each of said bulbous end and said groove end and said angled corner extend said elongated length, said bulbous end is adapted to be slidably inserted into said groove end defining a respective mated corner, then forming a housing having a plurality of angled corners and a plurality of mated corners, then defining a cavity within said housing and then defining a plurality of housing sides between said angled corners and said mated corners, corner flanges formed on each of said angled corners and each of said mated corners, said corner flanges formed in parallel to each other and extending said elongated length of said power strip, each of said corner flanges defined by an exterior surface between two opposing flange edges, a source power cord for receiving power from said power source, and a plurality of power outlets disposed on at least one of said housing sides and adapted to receive said respective plurality of power cords.

2. The power strip of claim 1, wherein said power strip further comprises, two end caps each of which having a flat portion of a shape defined by a cap flat edge and defined by said cavity and having a cap flange extending orthogonally from said flat portion at said cap flat edge, said cap flange having a plurality of cap corners each adapted to respectively receive on an interior surface of said cap corners a respective one of said exterior surfaces of said corner flanges.

3. The power strip of claim 1, wherein each of said angled corners have a bulbous groove extending the length of said power strip, said power strip further comprises, two end caps each of which having a flat portion of a shape defined by a cap flat edge and defined by said cavity and having a cap flange extending orthogonally from said flat portion at said cap flat edge, said cap flange having a plurality of cap corners each adapted to respectively receive on an interior surface of said cap corners a respective one of said exterior surfaces of said corner flanges, each of said two end caps have a plurality of screw holes in alignment with said bulbous grooves of said angled corners for screwing said two end caps to respective distal and proximal ends of said power strip, said cap flanges of said two end caps extending towards each other when screwed into said proximal and distal ends of said power strip.

4. The power strip of claim 1, wherein said power strip further comprises, at least one clip having a flat portion with two opposing flat edges between which is a hole through said flat portion, and having two arms connected to said flat portion and extending in a plane of said rectangular flat portion and in parallel to each other from said opposing flat edges, said arms having an interior surface adapted to receive said exterior surfaces of said corner flanges and having arm grooves at respective orthogonally extending ends of said arms, said arm grooves adapted to receive one of said flange edges of one of said mated corners and to receive an opposing one of said flange edges of one of said angled corners, said at least one clip adapted to clip anywhere along said elongated length of said power strip between said flange edge of said mated corner and said opposing flange edges of said angled corner.

5. The power strip of claim 1, wherein said power strip further comprises, at least one clip having a flat portion with two opposing flat edges between which is a hole through said flat portion, having two spacers respectively extending orthogonally in parallel from said two opposing flat edges, and having two arms respectively connected to said two spacer and extending in a plane of said rectangular flat portion and in parallel to each other from said spacer, said arms having an interior surface adapted to receive said rounded exterior surfaces of said corner flanges and having arm grooves at respective orthogonally extending ends of said arms, said arm grooves adapted to receive one of said flange edges of one of said mated corners and to receive an opposing one of said flange edges of one of said angled corners, said at least one clip adapted to clip anywhere along said elongated length of said power strip between said flange edge of said mated corner and said opposing flange end of said angled corner.

6. A power strip for distributing power from a power source to a plurality of electronic modules through a respective plurality of power cords, said power strip comprising, two elongated pieces each having a bulbous end and a groove end between which is a right angled corner all extending an elongated length of said two elongated pieces, each bulbous end is adapted to be slidably inserted into each groove end forming a right angled mated corner, said two elongate pieces having two right angled mated corners and two right angled corners when said bulbous ends are inserted into a respective groove ends then defining four sides each of which is between one of said two angled corners and one of said two right angled mated corners and then defining a square cross section cavity within said housing, each of said two right angled mated corners and said two angled corners having respective corner flanges in parallel to each other and extending said elongated length of said power strip, each of said corner flanges are defined by a rounded exterior corner surface between two opposing flange edges, a source power cord for receiving power from said power source, and a plurality of power outlets disposed on one of said sides and adapted to receive said respective plurality of power cords.

7. The power strip of claim 6, wherein each of said angled corners have a bulbous groove extending said elongated length of said power strip, said power strip further comprises, two end caps each of which having a square flat portion defined by cap flat edges and defined by said cavity and having a cap flange extending orthogonally from said cap flat edge, said cap flange having a plurality of cap corners adapted to respectively receive on an interior surface of said cap corners said rounded exterior surfaces of said corner flanges, said two end caps having two diagonally opposed screw holes in alignment with said bulbous grooves of said angle corners for screwing said two end caps to respective distal and proximal ends of said power strip, said cap flanges of said two end caps extending towards each other when screwed into said proximal and distal ends of said power strip.

8. The power strip of claim 7, wherein at least one of said two end caps has a recess for supporting a double D circuit breaker electrically connected between said source power cord and said plurality of power outlets.

9. The power strip of claim 6, wherein said power strip is for distributing power within an electronic module supporting means using a fastening means to fasten said power strip to said supporting means, said power strip further comprises, at least one clip having a rectangular flat portion with two opposing flat edges between which is centered a hole through said flat portion, having two semi circle groove spacers respectively initially extending orthogonally in parallel from said two opposing flat edges and curving away from said two opposing flat edges to respective farthest points from said flat portion and curing away from said farthest points to orthogonally terminate at two respective spacer edges in parallel to said two opposing flat edges and to said flat portion, having two arms respectively connected to said two spacer edges and extending in a plane of said rectangular flat portion and in parallel to each other from said spacer edges, said two arms having interior surfaces adapted to receive respective ones of said rounded exterior surfaces of two respective ones of said corner flanges, said arms have respective arm grooves at respective ends of said arms, said arm grooves adapted to receive one of said flange edges of one of said two right angled mated corners and to receive an opposing one of said flange edges of one of said two angled corners, said at least one clip adapted to clip anywhere along said elongated length of said power strip between said flange edge of said right angled mated corner and said opposing flange end of said angled corner, said spacer for defining a space between one of said four sides of said housing and said flat portion and between said farthest points buttressing said side, said space for receiving said fastening means.

10. The power strip of claim 9 wherein one of said arms further comprise a lever means extending from one of said arms for manual manipulation of said one arm to facilitate the removal or insertion of said at least one clip onto or off of said one side of said power strip.

11. A clip for fastening an external support using a fastening means to a power strip distributing power from a power source to a plurality of electronic modules through a respective plurality of power outlets, said power strip having a housing of four sides and four corners having corner flanges in parallel to each other all of which extending an elongated length of said power strip, each of said corner flanges defined by an exterior corner surface between two opposing flange edges, said clip comprising, a rectangular flat portion having two opposing flat edges between which is a hole through said flat portion, and two arms respectively connected to said two opposing flat edges and extending in a plane of said rectangular flat portion and in parallel to each other from said opposing flat edges, said two arms having interior surfaces adapted to receive respective ones of said exterior surfaces of two respective ones of said corner flanges, said arms have respective arm grooves at respective orthogonally extending ends of said arms, said arm grooves adapted to receive respective one of said flange edges of one of said corners and one of said opposing flange edges of another one of said corners, said clip adapted to clip anywhere along said elongated length of said power strip between said one corner and said another corner defining one side of said housing, said arms defining a space between said flat portion and said side, said space for receiving said fastening means.

12. The clip of claim 11 wherein said clip further comprises, two semicircle spacers respectively initially extending orthogonally in parallel from said two opposing flat edges to respective farthest points from said flat portion and there extending away from said farthest points to orthogonally terminate at two respective spacer edges parallel to said opposing flat edges and said flat portion, said two arms respectively connected to said two spacer edges and extending in parallel to each other from said spacer edges, said spacer for defining said space between said one side and said flat portion and between said farthest points buttressing said one side.

13. The power strip of claim 11 wherein said clip further comprises a lever means connected to and extending orthogonally from one of orthogonally extending ends of said arms and having friction grooves for manual manipulation of said one arm to facilitate removal or insertion of said clip onto or off of said one side of said power strip.

* * * * *